United States Patent [19]

Schelling

[11] Patent Number: 4,490,899

[45] Date of Patent: Jan. 1, 1985

[54] METHOD OF AND APPARATUS FOR REMOVING COUPLING MEMBERS FROM A SLIDE FASTENER

[75] Inventor: Gilbert Schelling, Richterswil, Switzerland

[73] Assignee: Hans Horlacher, Adliswil, Switzerland

[21] Appl. No.: 497,592

[22] Filed: May 24, 1983

[30] Foreign Application Priority Data

Jun. 4, 1982 [CH] Switzerland ..... 3474/82

[51] Int. Cl.[3] ..... B21D 53/52; A41H 37/06

[52] U.S. Cl. ..... 29/410; 29/407; 29/409; 29/770

[58] Field of Search ..... 29/33, 410, 407, 409, 29/767, 770, 768

[56] References Cited

U.S. PATENT DOCUMENTS

| | | | |
|---|---|---|---|
| 2,987,809 | 6/1961 | Burbank | 29/770 |
| 3,611,545 | 10/1971 | Takamatsu | 29/770 |
| 3,812,573 | 5/1974 | Fukuroi | 29/770 |
| 3,812,754 | 5/1974 | Kawakami | 29/770 |
| 3,863,323 | 2/1975 | Takamatsu | 29/770 |

*Primary Examiner*—Howard N. Goldberg
*Assistant Examiner*—Steven E. Nichols
*Attorney, Agent, or Firm*—Laubscher, Philpitt & Laubscher

[57] ABSTRACT

The two coupling member supporting bands are led between a guide block and two clamping members in a vertical position and having the coupling members located at the lower side. The coupling members are aligned with the path of cutting members by means of a countersupport having two gripping members and positioned relative to the cutting members by means of a scanning apparatus. The clamping members clamp the supporting bands as well as the coupling members which are to be removed. After the coupling members have been clamped by the clamping members, the cutting members sever the coupling members at their foot section and thereafter the cut coupling members are pulled off the supporting band by means of the countersupport and the clamping members. This allows an impeccable cutting of the coupling members and that all cut coupling members can be drawn off the supporting band.

2 Claims, 2 Drawing Figures

METHOD OF AND APPARATUS FOR REMOVING COUPLING MEMBERS FROM A SLIDE FASTENER

BACKGROUND OF THE INVENTION

1. Field of the Invention

The present invention relates to a method of removing coupling members from a slide fastener having a pair of coupling member supporting bands and spirally or meander shaped coupling members located at opposite longitudinal edges of said supporting band and coupled to each other, which coupling members comprise a head section and a foot section.

The invention relates further to an apparatus for removing coupling members from a slide fastener having a pair of coupling member supporting bands and spirally or meander shaped coupling members located at opposite longitudinal edges of said supporting band and coupled to each other, which coupling members comprise a head section and a foot section.

2. Description of the Prior Art

Several methods and apparatuses of above described kind are generally known and have as common characteristic the procedure of severing initially the head sections of the coupling members of a slide fastener in a coupled condition by the agency of a stamping tool whereupon the sections of the cut coupling members remaining initially on the supporting band are removed therefrom.

A known design of an apparatus operating in accordance to above procedure or method, respectively, is provided with a stamping apparatus for severing the head sections and a further apparatus for removing the remaining sections of the coupling members, which latter apparatus is located at a distance of mentioned stamping apparatus and comprises two counter-rotating disks including teeth extending along the circumference thereof, by means of which the remaining sections of the coupling members are torn off the supporting band.

A method of and apparatus for removing coupling members from a slide fastener band are disclosed in the CH-A-543 866. According to this disclosure the head sections of the coupling elements are cut by the agency of a stamping tool and the remaining sections of the coupling elements are pulled off the supporting bands following the same method as explained above. The apparatus for carrying out this method operates differently in comparison with the apparatus mentioned above in that the cutting of the head sections and the removing of the remaining sections is carried out following two method steps in one and the same apparatus.

The practical operation has shown that none of the above mentioned designs leads to satisfactory results. Difficulties arise specifically because above methods and procedures are applied to a closed slide fastener band. A danger of damaging the yarns of the textile web and of the supporting bands is always present if cutting or severing, respectively, the coupling members in a condition in which they are coupled together and, furthermore, a slight cutting of the head sections located at the ends of the section of the slide fastener which is not to have coupling members cannot be prevented. A specific drawback is that the number of the cut head sections is larger than the number of removed foot sections in case a gripping and partly tearing off of the slightly cut coupling members shall be prevented, which leads to a remaining of at least one foot section in the supporting band at both ends of the slide fastener section having no coupling members and a further drawback is that the foot sections are removed in a direction of the supporting band and in the last phase of this removing step the supporting band is no longer safely held.

SUMMARY OF THE INVENTION

Hence, it is a general object of the present invention to provide a method of removing coupling members from a slide fastener comprising the steps of disengaging the coupling elements from one another and of arranging the supporting bands in a substantially vertical condition and symmetrically relative to a center plane; of arranging one section of the supporting bands such that their coupling members are aligned at their foot section with the path of a cutting member; of positioning the coupling members which are to be removed relative to the cutting members; of clamping the sections of the supporting bands and of arresting the foot sections of the coupling members of said sections; of clamping the head sections of the coupling members to be removed; of cutting the foot sections in a direction extending parallel to the supporting bands; and of pulling off the coupling members clamped at the head sections in a direction away from the supporting members whereby a coupling memberless section is produced.

Another object of this invention is to provide an apparatus for removing coupling members from a slide fastener, comprising two cutting members arranged to cut the foot sections in a direction extending parallel to the supporting bands; a stationary guide block operative to uncouple the coupling members and to arrange the supporting bands vertically and symmetrically relative to one another; a countersupport movable relative to the stationary guide block such to align the coupling members; a means for scanning at least one of the voids between the coupling members remaining on the supporting band and such coupling member which is to be removed from the supporting band such to position the coupling members relative to the cutting members; two clamping members mounted to the guide block and movable relative thereto and operative to clamp the sections of the supporting bands and arrest the foot sections of the coupling members of mentioned sections; two gripping members located at the countersupport and movable relative to the guide block and operative to clamp the head sections of the coupling members to be removed; which two cutting members are guided in each one of said clamping members and are movable relative to the guide block in order to cut the foot sections of the coupling members parallel to the supporting band; and which countersupport and which gripping members are together movable away from the guide block in order to remove the cut coupling members from the supporting bands.

The advantages of the inventive method and inventive apparatus are mainly that the coupling elements are cut at their foot sections and that due to the fact that there is a space between two coupling members because the slide fastener band has been opened, all cut coupling members may be removed and the cut coupling members are pulled off the supporting band in a direction leading away therefrom and in a clamped condition of the supporting bands. This allows a free pulling off and removing of the coupling members without a damaging of the yarns of the web.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figure 1:
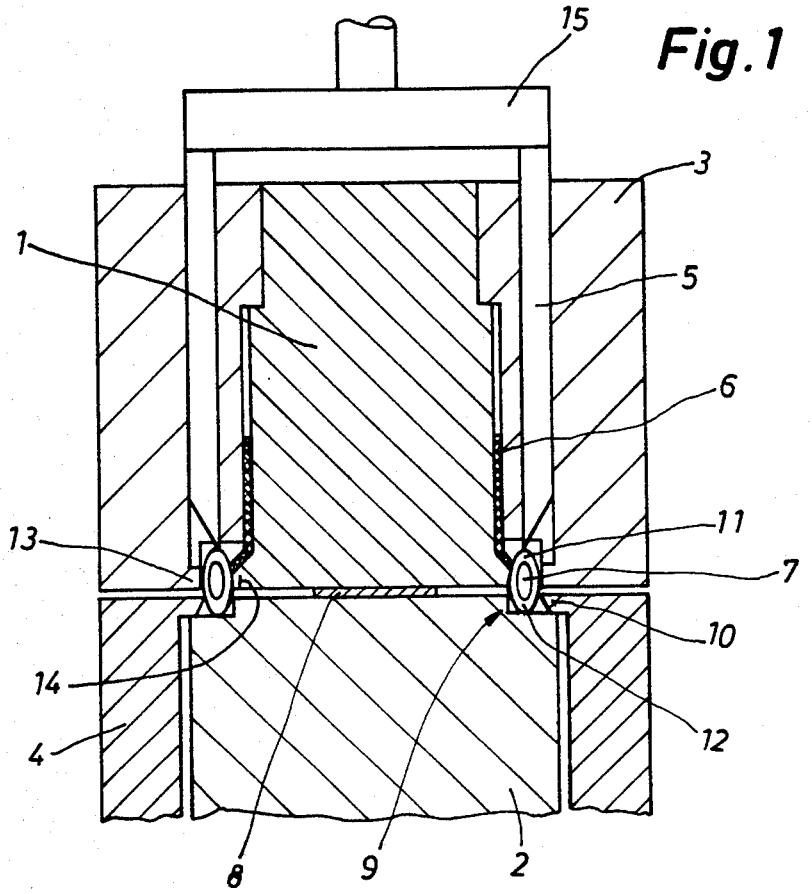
FIG. 1 is a schematic view of a section through a first embodiment of an apparatus for removing coupling members.

Describing now the drawings, and considering initially the exemplary embodiment as shown in FIG. 1, it will be understood that the apparatus comprises a guide block 1, a countersupport 2, two clamping members 3, two gripping members 4 and two cutting members 5.

Figure 2:
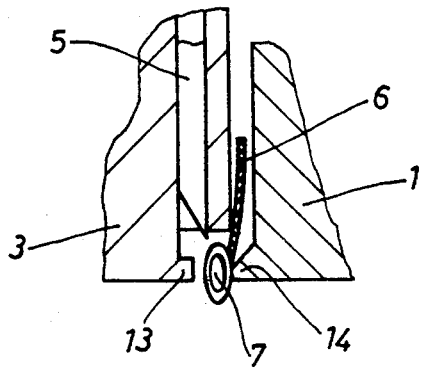
FIG. 2 is a view of a detail of the apparatus shown in FIG. 1 illustrating the apparatus in a position in which the slide fastener band is inserted into the apparatus.

A complete slide fastener drawn off a roll is opened at and by a not specifically shown portion of the guide block 1 and the two supporting bands 6 having been separated accordingly are inserted in a vertical position in which their coupling members 7 are located at the bottom edge thereof between the guide block 1 and the clamping members 3 such as clearly shown in FIG. 2. The separating, i.e. opening, of the slide fastener immediately prior to its entering into the apparatus insures that the distance between the individual interstices at both coupling member chains of the slide fastener have exactly the same dimension. The transporting device for the slide fastener band and the control apparatus operating with the transporting device and with which the distance or intervals, respectively, between the sections of the slide fastener which are to have no coupling members is not described in detail because it is generally known.

Before the section of the supporting bands of the slide fastener from which section the coupling elements shall be removed reaches the apparatus the countersupport 2 is raised together with the gripping elements 4 until it abuts the guide block 1. A distance piece 8 may be provided in order to allow an adjusting of the apparatus to individual dimensions of coupling members of various slide fastener bands.

A shoulder 9 each is located at the opposite sides of the countersupport 2 and the gripping elements 4 contact said shoulders 9 at a gripping section 10 projecting inwards such that a space is produced between the edge of each shoulder and the gripping section 10, which space is to guide the coupling members such that they are aligned with the path of the cutting members 5 in the raised condition of the countersupport 2. In such position the foot section 11 of the coupling members 7 project in a direction towards the cutting member 5 and rest at their head section 12 on the shoulder 9.

Before the removing proper of the coupling members 7 is initiated, the coupling members 7 which are to be removed are exactly aligned with the cutting members 5 such that the face edges of the cutting members 5 are located each on an interstice between two coupling members 7. This is arrived at by means of an optical scanning of a not particularly illustrated scanning device of known design, such as a light conducting scanning device, i.e. the operation of the slide fastener band transporting device will be stopped as soon as this interstice has been determined.

This determination of the interstice is a ON-order for the now following removal of the coupling members 7. Firstly, the two clamping members 3 which are held on the opposite sides of the guide block 1 are moved against the guide block 1 and accordingly the supporting band 6 will be clamped. A projection 13 projecting at the lower end of the clamping members 3 inwards rests in this position on the center area of the coupling members 7 and urges the coupling members against a further projection 14 located at the lower end of the guide block 1 and accordingly the coupling members 7 are arrested.

Thereafter the gripping members 4 are moved against the countersupport 2 such to move the gripping sections 10 into engagement with the head section 12. The foot sections 11 of the coupling members 7 will be cut open by the lowering of the cutting members 5 operated by the piston 15.

Following this the countersupport 2 including its gripping members 4 is lowered and the coupling members 7 which are clamped between the shoulders 9 and the gripping sections 10 and having their foot sections 11 cut are removed in a direction leading away from the supporting band 6.

Finally, the gripping members 4 are lifted off the countersupport 2 and the coupling members 7 which now have been removed will be pushed out by means of a suitable device, for instance, a not particularly shown pusher.

Thereafter the apparatus is brought again into its initial position for removing the coupling elements of the next following section of the slide fastener.

Advantageously, a braking device is provided acting on the slide fastener band being led from the roll allowing the establishment of a sufficient tension when feeding the slide fastener band.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A method of removing coupling members from a slide fastener having a pair of coupling member supporting bands and spirally or meander shaped coupling members located at opposite longitudinal edges of said supporting band and coupled to each other, which coupling members comprise a head section and a foot section, comprising the steps (a) of disengaging said coupling elements from one another and of arranging said supporting bands in a substantially vertical condition and symmetrically relative to a center plane, (b) of arranging one section of said supporting bands such that their coupling members are aligned at their foot section with the path of a cutting member, (c) of positioning the coupling members which are to be removed relative to said cutting members, (d) of clamping the sections of said supporting bands and of arresting the foot sections of the coupling members of said sections, (e) of clamping the head sections of the coupling members to be removed, (f) of cutting said foot sections in a direction extending parallel to said supporting bands, and (g) of pulling off the coupling members clamped at their head sections in a direction away from said supporting members whereby a coupling memberless section is produced.

2. An apparatus for removing coupling members from a slide fastener having a pair of coupling member supporting bands and spirally or meander shaped coupling members located at opposite longitudinal edges of said supporting band and coupled to each other, which coupling members comprise a head section and a foot section, comprising two cutting members arranged to cut said foot sections in a direction extending parallel to said supporting bands; a stationary guide block operative to uncouple said coupling members and to arrange said supporting bands vertically and symmetrically relative to one another; a countersupport movable relative to said stationary guide block such to align said coupling members; a means for scanning at least one of the voids between the coupling member remaining on said supporting band and such coupling member which is to be removed from said supporting band such to position said coupling members relative to said cutting members; two clamping members mounted to said guide block and movable relative thereto and operative to clamp the sections of said supporting bands and arrest the foot sections of the coupling members of mentioned sections; two gripping members located at said countersupport and movable relative to said guide block and operative to clamp the head section of the coupling members to be removed; which two cutting members are guided each in one of said clamping members and are movable relative to said guide block in order to cut the foot sections of said coupling members parallel to said supporting band; and which countersupport and which gripping members are together movable away from said guide block in order to remove the cut coupling members from said supporting bands.

* * * * *